United States Patent [19]

Iruretagoyena

[11] 4,020,763

[45] May 3, 1977

[54] CARTRIDGE CONSTRUCTION

[76] Inventor: Antonio Iruretagoyena, Calle Adriano VI,18, Vitoria, Spain

[22] Filed: Nov. 5, 1975

[21] Appl. No.: 629,122

[30] Foreign Application Priority Data

Apr. 29, 1975 Spain ..... 211994

[52] U.S. Cl. ..... 102/44

[51] Int. Cl.[2] ..... F42B 7/06

[58] Field of Search ..... 102/42, 43 P, 44, 38

[56] References Cited

UNITED STATES PATENTS

| | | | |
|---|---|---|---|
| 3,157,121 | 11/1964 | Daubenspeck et al. | 102/42 |
| 3,246,603 | 4/1966 | Comerford | 102/42 |
| 3,577,924 | 5/1971 | Findlay et al. | 102/42 |
| 3,756,156 | 9/1973 | Schuster | 102/43 P |

FOREIGN PATENTS OR APPLICATIONS

| | | | |
|---|---|---|---|
| 1,096,658 | 12/1967 | United Kingdom | 102/44 |

*Primary Examiner*—Verlin R. Pendegrass
*Attorney, Agent, or Firm*—Karl W. Flocks

[57] ABSTRACT

An improved cartridge comprising an outer case member, an inner base member and an intermediate bushing member wherein the case may be plastic or similar material, the inner base member is of plastic or any other material, and the bushing member formed by injection between the case member and the base member. The intermediate bushing formed and interposed between the case member and the base member closely joins the case to the base to form a monobloc assembly.

7 Claims, 8 Drawing Figures

CARTRIDGE CONSTRUCTION

BACKGROUND OF THE INVENTION

1. Field of the Invention

The field of the invention relates to an improved cartridge, which is believed to be encompassed by art in Class 102/38 and indented sub-classes.

2. Description of the Prior Art

The hunting cartridges which are known heretofore include among their material constituents plastic. Plastics, in general, as they are well known, have a relatively low cost in comparison with other materials of construction and because they can be subjected to injection molding processes or manipulation, they are highly desirable material in the industry as a substitute for the classic materials.

As mentioned above, the use of plastics in the manufacture of cartridges is desirable but up to the present time even with the low construction cost of an element totally made in plastic without metallic reinforcement and with enough mechanical resistance to be utilized in its totality and able to be recharged, the use of plastics in the manufacture does not appear to have been accepted or widely practiced.

On the other hand, plastics have a disadvantage of requiring a cooling time in accordance with the thickness applied to the product that is formed by injection molding. In the injection molding process, particularly when the product thickness is considerable, the shrinkages are normally produced in the material in such a way that stress concentration appears in these shrinkages later on that may spoil the material. Therefore, it would be ideal to produce products having wall thickness reduced to the maximum permissible degree possible when employing plastics as a material of manufacture to eliminate shrinkage problems and also to reduce the required cooling time.

In the cartridge fabrication techniques, the use of a plastic cartridge case and the use of a single plastic piece which serves as a bottom and a base for the cartridge appear to be known in principle.

In the foregoing case, the thickness of the inner plastic piece invariably must be sufficiently dimensioned or thickened to theoretically provide the cartridge with adequate or corresponding mechanical strength. However, practice of the foregoing process resulted in an extraordinary slow fabrication process and a difference of resistance between the inner plastic piece and the case. Also in use of such parts made in plastic, separation of both zones occurred at times at the moment of powder-fumes expansion with the risks that it implies and making such use unadvisable. Consequently, these procedures never translated into practical use but remained only in theory. As a result, such use of plastic has not materialized heretofore due to the fabrication problems, forbidden cost and lack of adequate mechanical resistance.

SUMMARY OF THE INVENTION

The cartridge construction of the present invention provides an article that can be made entirely in plastic, with a great resistance mechanical in all aspects, with very low cost, and with the possibility of being in combination with other types of materials, without any loss of its characteristics.

BRIEF DESCRIPTION OF THE DRAWINGS

For a better understanding of the present invention, reference is now made to the drawings in which.

DETAILED DESCRIPTION OF THE INVENTION

Figure 1:
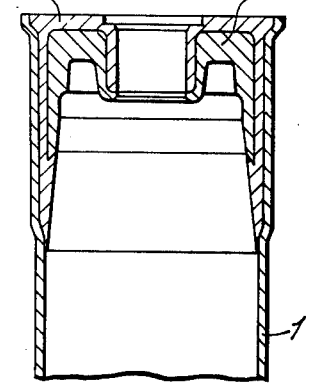
FIG. 1 shows a partial view in section of a cartridge made according to the present invention.

Referring now in detail to the drawings, the cartridge, according to the present invention, is seen in FIG. 1 to comprise three main pieces which are: the case 1, base 3 and the cover piece or intermediate bushing 2.

The case 1 is made by a process employed in other techniques and constitutes a bioriented extrusion tube of thermoplastic material.

The base 3 is an injection molded body of thermoplastic material, preferably, but depending on the different applications it may be of the shot type or it can be made of any other type of material.

The cover piece or intermediate bushing 2 is an element of injection molded plastic.

In the fabrication of the cartridge according to the invention, the base 3 is made independently from the rest of the pieces and does not require at any moment any extreme accuracy, and may be fabricated in a great number of pieces and at a very low cost. As may be seen in FIGS. 2, 7 and 8, the free end of the said base 3 presents an internal circular bevel portion 11 or 11' with respect to the longitudinal axis of the cartridge. Because of the foregoing aspect, there have been illustrated precisely in FIGS. 2, 7 and 8 different angles for this bevel portion.

Figure 2:
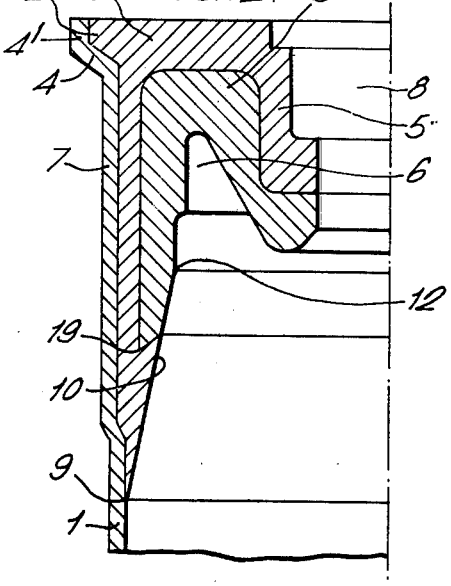
FIG. 2 shows other possible features of the present invention in an enlarged portion of the cartridge of FIG. 1.

This base 3 is enclosed in the inner portion of the cartridge and does not extend to the outer part, and as may be clearly seen is totally embraced by the edge of the intermediate bushing 2 and it will only find itself free of contact with the intermediate bushing 2 in the zone 6 of the base 3 as best seen in FIG. 2.

The distance between the wall or outer surface of base 3 with respect to the cartridge case and the base portion of the case is significantly reduced so that the bushing in its entirety may also be reduced in thickness.

When the base 3 and the bushing 2 are both of thermoplastic material there will be no problem or difficulty due to the gripping or adherence between them as it will be basically of similar characteristics, obtaining in this way a monobloc body.

Nevertheless, when the base 3 is made from other materials as thermostable, metals, special cartons, etc. with suitable hooking members 18 being provided on the external surface of the base 3, so that the realization of a perfect monobloc unit may be obtained consistently.

Where the thickness of intermediate bushing 2 is greatly reduced and the bushing is injection molded from thermoplastic material, quick cooling of the product is provided and also any possibility of shrinkages, which are normally dangerous for the purposes proposed, is totally eliminated, above all in the zone of the housing of the piston.

FIG. 2 clearly shows the relative positions of the principal elements of the cartridge, namely case 1, base 3, and intermediate bushing 2. The bushing 2 completely surrounds the exterior of base 3 in its entirety in suitable proportion at the side of the case, in its base zone and in its central zone for further housing of the piston. The case 1 is almost cylindrical and presents an upper lateral rib 4 and a thickened diameter portion of slightly above the remaining of the portions and thereby provides the perfect enclosure and housing for use in a shot-gun in which it is to be used.

The intermediate bushing 2 has a length greater then the base 3 and overpasses the latter internally by a reasonable measure, providing also a lap 10 for suitably housing the bevel portion 11 in the base 3.

Bushing 2 includes an outwardly extending rib 2' that is surrounded laterally by the rib 4 and its vertical component 4'. The central zone 5 of the bushing 2 provides a housing portion for the primer 8 and rests against a neck portion of the base 3.

Figure 8:
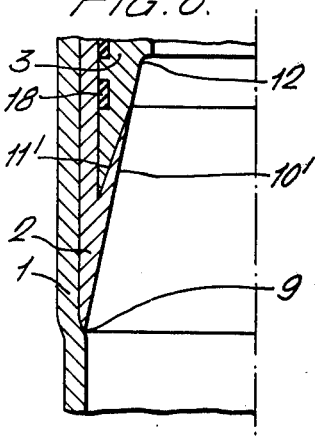
FIG. 8 shows inner form of the cartridge according to the present invention.
Figure 7:
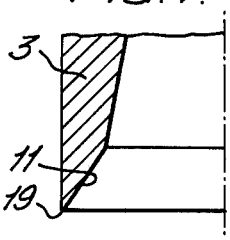
FIG. 7 shows a detail of the inner end of the bottom piece in FIGS. 1 and 2.

It has been indicated above that the angle of the bevel 11 with respect to the longitudinal axis of the cartridge could be altered and in this sense they have been described graphically in FIGS. 2, 7 and 8. In this regard where the base 3 is not of thermoplastic material but is of a material different from that of the bushing 2, the bevel 11' will form a smaller angle with the mentioned axis and consequently it will extend at more vertical direction as may be seen in FIG. 8 that will be adopted preferably in combination with the existence of the mediums and notches 18 and provided between both elements. It is therefore defined that the free internal end of the base 3 and the bevel 11 will be left totally included in the intermediate bushing 2 by lap portion 10 or 10' thereof and extending in some applications up to interior portions 6 or 12 of base 3.

The intermediate bushing 2, itself is of gradually lessening wall thickness, extends to a point 9 of insignificant thickness that will define its intersection with the inner part of case 1. With all this and apart from getting a perfect union between bushing 2 and the case 1, an arrangement is also provided in which there is no significant difference of internal stresses between such materials and which is of significant importance at the time of firing the shot whereby the possibility of a lateral escape in the combustion is positively avoided and which otherwise would render the cartridge useless.

The improved results provided in the disclosed arrangement is essentially due to the accuracy obtained by the perfect injection molding of intermediate bushing 2 with the walls being extraordinary thin. Also, it is well known that ordinarily such severe changes in the inner diameter of the cartridges would produce a frank irregularity in the quality of the obtained shot, in contrast to the arrangement disclosed herein.

Moreover, the zone 5 of the bushing 2 is of very little or reduced thickness to provide a perfect housing and accommodation for the piston, without any possibility of expulsion or movement of itself at the moment a shot is fired.

Basically, the cartridge is defined by the existence of three independent pieces, case 1, bushing 2 and base 3, which as duly connected form a monobloc assembly, give a proportionately low cost element with extraordinary resistance, good accuracy and good fire power.

The base 3 according to the present invention can be of the same or different material that bushing 2 is previously formed without great exigencies, allowances and accuracy as at a later stage of assembly, it is covered by the injected intermediate bushing 2, for which we repeat, it does not require a great precision in its form and measures, great series, at high speed, and with the consequent economy of the final cartridge can be produced.

If the material of which base 3 is constituted is thermoplastic, its external walls will be totally flat, but when the cartridge as required for usage in special shootings or of high responsibility or precision, the quality of the material will be changed into plastic, wood, metals, etc.

In the particular case where the bushing 2 and the base 3 are not of the same material, adherence will be reduced and the hooking members 18 suitable for forming a unique and monobloc assembly will be provided.

Once the base 3 is made, it is inserted into the cartridge case 1 in order to constitute a space hole between such base 3 and the cartridge case 1. In this space which has small thickness, thermoplastic material is thereafter injected to form the intermediate bushing 2 which gradually extends with lessening thickness to meet the case 1 practically in a point 9, in a way that a close union is obtained between the pieces. At the same time this hot injection is carried out, there are accommodated by the outer part of the wall the appropriate moulds to form in the zone of the upper ribs 4 and 4' of the case 1 the protruding peripheral portion 2' of bushing 2. The illustrated increase of external diameter of upper rib 4 and outer portion 4' of the case 1 is provided for further inclusion in the firearm without significant additional cost requirement.

Figure 5:
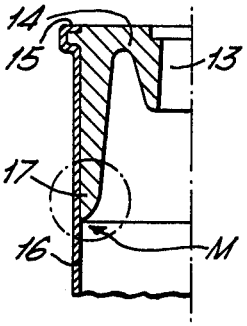
FIG. 5 shows a sectional view of a conventional cartridge, produced by the total injection of plastic in which a zone of the cartridge marked M is weakened by the thickening of the final zone.
Figure 3:
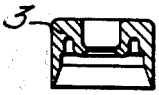
FIG. 3 shows the bottom piece for the cartridge of FIG. 1.
Figure 4:
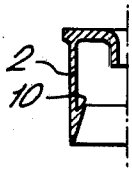
FIG. 4 shows a sectional view of an intermediate piece employed in the cartridge of FIG. 1.
Figure 6:
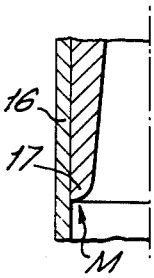
FIG. 6 shows on an enlarged scale a detail in the circled zone in FIG. 5.

As an optional feature of the construction illustrated in FIG. 2 the vertical outer component 4' of the case 1 may be formed on its free end with a radially inwardly extending circular or annular reinforcement boss 15, as seen in FIG. 5, in clamping relationship over intermediate bushing 2 near the theoretical meeting zone between case 1 and intermediate bushing 2.

In these conditions, the extraction collars formed at 4,4' of case 1 acquire the adequate resistance, without requiring a further stress, thus securing its perfect expulsion, in all types of guns even in the automatic guns.

The bushing 2 also embraces to a greater or lesser degree the internal bevel 11 of base 3 in scope of the embracing relationship depending upon the material utilized for the construction of the base 3.

Other detail to which should be noted is the fact that when the cartridge is loaded, the wad that covers the gun powder has the tendency to abut against the bushing 2 to preclude the direct contact of the gun powder with the point 9 of bushing 2 and thereby avoiding possible lateral escape at the moment of the shooting. Equally, the internal surface established between 12 and 9 being of some conicity does not present any rib along its entire length.

The advantages that are afforded by a cartridge made according to the present invention are countless, including the following:

1. The extraordinary union between the integral pieces acquired through the further injection of the bushing 2 that avoids the leakage during combustion, constituting a cartridge of posterior quality and monobloc.

2. As the union between the case and the bushing is formed with progressive reduction of bushing thickness, there is obtained at the combustion moment a balance between the internal stress of case and that of the bushing at the same time so that shots of great accuracy and power are obtained for equal amounts of smoke.

3. The piston housing is perfect, obtaining a total tightness and avoiding the necessity of any other additive as can be metallic bushings, internal pieces for piston fixing etc.

4. The base and intermediate bushing materials can be equal or different, increasing the versatility of the cartridge utilization. In the case in which the base is not thermoplastic, the plastic lining of the bushing 10 provides therefore a great resistance against flame and the combustion hot gases which undoubtedly resounds at the recharge effects in a higher resistance to head traction.

5. Less quantity of gun powder is required in a cartridge made according to the present invention to provide the same results that are obtained in conventional cartridges due to the peculiar conception of its inner part.

6. The fabrication cost is very low as the injected thickness may be quite low, and great quantities may be produced at a great production rate. They allow in any case their reuse as they can be recharged since they do not undergo any significant transformation as a result of being fired.

7. Besides of the ease of fabrication of the cartridge, it may because of the construction of the extraction collar be reused even in the most unfavorable conditions of its usage in automatic guns.

8. The cartridge thickened portion 7 of case 1 obtained in the injection process guarantees its perfect housing in the gun without any breadth, the function normally carried out in the cartridge known by the metallic bushing.

9. Total impossibility of lateral escapes of gases in reason of the bushing length along the interior of the case.

10. The special formation of zones 10 and 10' of bushing 2 and portions 11 and 11' of base 3 render any escape of gases impossible in their concentration zones.

It will be obvious to those skilled in the art that various changes may be made without departing from the scope of the invention and the invention is not to be considered limited to what is shown in the drawings and described in the specification.

What is claimed is:

1. Improved cartridge without metallic reinforcement portions comprising an exterior or case, an internal or base member and an intermediate bushing member all of which are of plastic material, said bushing member being disposed between said case and said base by injection and closely joining said case and said base to provide an assembly forming a monobloc body provided with central orifice for a primer, said bushing member having laterallly extending portions extending externally of and over laterally extending portions of said base member so that said base member is completely enclosed within said cartridge.

2. Improved cartridge, as defined in claim 1, characterized in that the case has a contour extending laterally of its axis to form an extraction collar.

3. Improved cartridge as defined in claim 2, characterized in that down from the extraction collar the case has a diameter greater than that in the rest of the cartridge for properly housing or reception into a gun.

4. Improved cartridge as defined in claim 3, characterized in that interior of the base does not enter into contact directly with the case and does not form part of the cartridge end and presents a central internal portion in contact with the gun powder, which provides resistance to the temperature and pressure conditions produced in the instant of firing, said base being united to the external case by means of the injected material rendering said intermediate bushing one conjunct body only.

5. Improved cartridge as defined in claim 4 so presented said base is in contact with said intermediate bushing having means for obtaining complete union between said base and said bushing obtained in a circular bevelling at one end of said base.

6. Improved cartridge as defined in claim 5, characterized in that the injected intermediate part closely joins the base, making the cartridge base and piston housing at the same time that surrounds the internal wall of said base in higher or lower degree, covering its bevel and extending towards its intersection with the cartridge case by means of a gradual lessening of the thickness of its wall, finishing in a point of insignificant thickness.

7. Improved cartridge as defined in claim 1 wherein said case extends over and covers said intermediate bushing member along annular side and end areas thereof and provides thereat an extraction member in the form of a circular boss on the end of the intermediate bushing member just at the meeting zone of the case and intermediate bushing member.

* * * * *